US009919513B2

(12) United States Patent
He

(10) Patent No.: US 9,919,513 B2
(45) Date of Patent: Mar. 20, 2018

(54) CIRCULATING FEEDING PRINTER COMBINING SCREEN PRINTING AND DIGITAL INK JETTING

(71) Applicant: TAOTECH DIGITAL TECHNOLOGY CO., LTD, Zhongshan, Guangdong (CN)

(72) Inventor: Tao He, Zhongshan (CN)

(73) Assignee: TAOTECH DIGITAL TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 15/445,468

(22) Filed: Feb. 28, 2017

(65) Prior Publication Data

US 2017/0266950 A1 Sep. 21, 2017

(30) Foreign Application Priority Data

Mar. 16, 2016 (CN) ..... 2016 1 0151093

(51) Int. Cl.

| | |
|---|---|
| ***B41F 15/08*** | (2006.01) |
| ***B41F 17/38*** | (2006.01) |
| ***B41F 19/00*** | (2006.01) |
| ***B41F 21/08*** | (2006.01) |
| ***B41J 3/407*** | (2006.01) |

(52) U.S. Cl.

CPC ..... *B41F 19/007* (2013.01); *B41F 15/08* (2013.01); *B41F 17/38* (2013.01); *B41F 21/08* (2013.01); *B41J 3/4078* (2013.01)

(58) Field of Classification Search

CPC ..... B41F 15/08; B41F 17/38; B41J 3/4078; B41M 1/12; B41M 1/26

USPC ..... 101/126

See application file for complete search history.

(56) References Cited

U.S. PATENT DOCUMENTS 6,089,149 A * 7/2000 Zelko ..... B41F 15/10 101/115
7,434,675 B1 * 10/2008 Rohm ..... H05K 13/0061 198/346.2
8,205,736 B2 * 6/2012 Ando ..... B41F 17/005 101/93.01

FOREIGN PATENT DOCUMENTS

CN 105235362 A 1/2016

OTHER PUBLICATIONS

Aug. 3, 2017 Office Action issued in Chinese Patent Application No. 201610151093.7.

* cited by examiner

*Primary Examiner* — Leslie J Evanisko
(74) *Attorney, Agent, or Firm* — Oliff PLC

(57) ABSTRACT

A circulating feeding printer combining screen printing and digital ink jetting, includes a rack. The rack includes an upper rack layer and a lower rack layer, and the two layers are respectively provided with a transmission platen capable of moving relative to the rack. Each transmission platen is provided with a movable printing platen bearing a print medium capable of sliding relative to the transmission platen, a locking device locking the movable printing platen, and the transmission platen is arranged between them. The platen transfer devices capable of transferring the movable printing platen onto the transmission platen at the different layer are disposed on the rack, separately located at two sides of the transmission platens. The rack is further provided with a screen printer and an inkjet printer used for printing separately.

14 Claims, 7 Drawing Sheets

CIRCULATING FEEDING PRINTER COMBINING SCREEN PRINTING AND DIGITAL INK JETTING

FIELD OF THE INVENTION

The present invention relates to a printer, and more specifically, to a circulating feeding printer combining screen printing and digital ink jetting.

BACKGROUND OF THE INVENTION

Existing screen printers and existing digital inkjet printers are independent devices. The two printing manners have respective advantages and disadvantages, and therefore, current screen printers and digital inkjet printers have shortcomings, for example, some color blocks that digital inkjet printing fails to print can be printed by screen printing, and some colors that the screen printing fails to print can be compensated by digital inkjet printing. So, quality of products printed by conventional screen printers and digital inkjet printers still needs to be improved. Therefore, an increasing number of users expect a printer that synchronously has the advantages of screen printing and advantages of digital inkjet printing, thereby improving the printing quality. Besides, whether the feeding mechanism of a conventional screen printer or the feeding mechanism of a conventional digital inkjet printer involves separate feeding, that is, material loading is performed at a printing station, and material taking is performed at the printing station after printing is completed, and therefore, a worker needs to wait at the printing station during a printing process of a print medium. This printing manner involves low production efficiency, low automation level, and high production costs. Further, the volume of a conventional printer is very huge, especially a printer involving a plurality of stations, which is very long. Therefore, an occupied area is very large, and land and plant costs of an enterprise are increased.

Therefore, the present invention is generated on the basis of the foregoing shortcomings.

SUMMARY OF THE INVENTION

The present invention aims to overcome the shortcomings of the prior art, provide a circulating feeding printer combining screen printing and digital ink jet printing with good printing quality, small occupied area, high production efficiency, high automation level, and low production costs.

The present invention is implemented by means of the following technical solution:

A circulating feeding printer combining screen printing and digital ink jetting, comprising: a rack 1, where the rack 1 includes an upper rack layer 11 and a lower rack layer 12, the upper rack layer 11 and the lower rack layer 12 are respectively provided with a transmission platen 2 capable of moving back and forth relative to the rack 1, each transmission platen 2 is provided with a movable printing platen 3 capable of sliding back and forth relative to the transmission platen 2 and used for bearing a print medium, a locking device 4 for locking the movable printing platen 3 and the transmission platen 2 is arranged between the movable printing platen 3 and the transmission platen 2, platen transfer devices 5 capable of transferring the movable printing platen 3 at the upper rack layer 11 onto the transmission platen 2 at the lower rack layer 12 and transferring the movable printing platen 3 at the lower rack layer 12 onto the transmission platen 2 at the upper rack layer 11 are further disposed on the rack 1, separately located at two sides of the transmission platens 2, and the rack 1 is further provided with a screen printer 6 used for carrying out screen printing and an inkjet printer 7 used for carrying out digital ink jetting on the print mediums on the movable printing platens 3.

In the circulating feeding printer combining screen printing and digital ink jetting described above, each of the platen transfer devices 5 includes a lifting platen 51 capable of lifting relative to the rack 1, each movable printing platen 3 is provided with a sliding chute 52/sliding chutes 52 or a sliding rail/sliding rails, the lifting platen 51 is provided with a sliding rail 53/sliding rails 53 or a sliding chute/sliding chutes capable of matching with the sliding chute 52/sliding chutes 52 or the sliding rail/sliding rails to enable the movable printing platen 3 on the transmission platen 2 to slide to the lifting platen 51, and the lifting platen 51 is further provided with a fastening device 54 capable of fastening the movable printing platen 3 and the lifting platen 51.

In the circulating feeding printer combining screen printing and digital ink jetting described above, the movable printing platen 3 is provided with a guide slot 81/guide slots 81 or a guide rail/guide rails that does/do not overlap the sliding rail 53/sliding rails 53 or the sliding chute/sliding chutes on the lifting platen 51, and the transmission platen 2 is provided with a guide rail 82/guide rails 82 or a guide slot/guide slots matching with the guide slot 81/guide slots 81 or a guide rail/guide rails to enable the movable printing platen 3 to slide on the transmission platen 2.

In the circulating feeding printer combining screen printing and digital ink jetting described above, the locking device 4 includes a locking cylinder 41 disposed on the transmission platen 2, a locking block 42 is connected to the cylinder rod 44 of the locking cylinder 41, and the movable printing platen 3 is provided with a locking slot 43 matching with the locking block 42.

In the circulating feeding printer combining screen printing and digital ink jetting described above, the fastening device 54 includes a fastening cylinder 541 disposed on the lifting platen 51, a fastening block 542 is connected to the cylinder rod of the fastening cylinder 541, and the movable printing platen 3 is provided with a fastening slot 543 matching with the fastening block 542.

In the circulating feeding printer combining screen printing and digital ink jetting described above, when the movable printing platen 3 is transferred from the transmission platen 2 onto the lifting platen 51, the transmission platen 2 slides to a position above the lifting platen 51, and the transmission platen 2 and the lifting platen 51 have a spatial overlapping region; and when the movable printing platen 3 is transferred from the lifting platen 51 onto the transmission platen 2, the transmission platen 2 slides to a position above the lifting platen 51, and the transmission platen 2 and the lifting platen 51 have a spatial overlapping region.

In the circulating feeding printer combining screen printing and digital ink jetting described above, the rack 1 is further provided with a spraying device 9 used for spraying and a drying device 10 used for drying the print medium on the movable printing platen 3.

As compared with the prior art, the present invention has the following advantages:

1. The present invention combines a screen printing function and a digital ink jetting function. In a printing process, screen printing may be used as a pre-process, and digital ink jetting is used as a post-process, so that the advantages of the screen printing and the advantages of the digital ink jetting are combined, and the screen printing and the digital ink jetting complement each other, thereby achieving better quality of printed products as compared with the quality of conventional printed products. Besides, the platen transfer devices respectively disposed at two sides of transmission platens can transfer the movable printing platen at the upper rack layer onto the transmission platen at the lower rack layer, and can also transfer the movable printing platen at the lower rack layer onto the transmission platen at the upper rack layer. Therefore, after a worker loads a print medium onto the movable printing platen at a material loading station, the platen transfer device transfers the movable printing platen onto the transmission platen at the lower rack layer or the transmission platen at the upper rack layer, then the transmission platen delivers the movable printing platen to the screen printer and the inkjet printer for printing, when the first movable printing platen in a printing process at the screen printer or the inkjet printer, the worker can load a material onto the other movable printing platen, and then the platen transfer device transfers the other movable printing platen with the loaded material, during the process of transferring the other movable printing platen, the print medium that is at the printing station first has completed the printing, the first movable printing platen is transferred to the material loading station, the worker takes the print medium printed, and again, loads a print medium to be printed, thereby implementing continuous material loading and material discharging. Moreover, the movable printing platens cyclically operate between the upper rack layer and the lower rack layer, thereby achieving circulating feeding, reducing waiting time of workers, and significantly improving the production efficiency. Furthermore, the cycle operation of the movable printing platens between the upper rack layer and the lower rack layer makes the present invention spatially extends upwards, thereby reducing an occupied area of the present invention and reducing land costs.

2. Each of the platen transfer devices of the present invention includes a lifting platen capable of lifting relative to the rack, each of the movable printing platens is provided with the sliding chute or the sliding rail, the lifting platen is provided with a sliding rail or a sliding chute matching with the sliding chute or the sliding rail to enable the movable printing platen on the transmission platen to slide to the lifting platen, and the lifting platen is further provided with the fastening device capable of fastening the movable printing platen and the lifting platen. When the movable printing platen is located on the transmission platen and needs to be transferred onto the lifting platen, the locking device locks the movable printing platen and the transmission platen, the transmission platen moves relative to the rack, in the moving process of the transmission platen, the sliding rail or the sliding chute on the lifting platen matches with the sliding chute or sliding rail on the movable printing platen, at this time, the fastening device is enabled, the fastening device fastens the movable printing platen and the lifting platen, then, the locking device is released, the transmission platen moves away from the lifting platen, at this time, the movable printing platen is transferred from the transmission platen onto the lifting platen, then the lifting platen is raised or lowered relative to the rack to arrive at the upper rack layer or the lower rack layer, and the lifting platen docked with the transmission platen of the upper rack layer or the transmission platen of the lower rack layer, so that the movable printing platen on the lifting platen is transferred onto the corresponding transmission platen, thereby completing the cyclic operation of the movable printing platen. This is a very clever design with simple and compact structure, implements continuous material loading and material discharging by workers, and improves the production efficiency.

3. In the present invention, the movable printing platen is provided with a guide slot/guide slots or a guide rail/guide rails that does/do not overlap the sliding rail or sliding chute on the lifting platen, and the transmission platen is provided with a guide rail/guide rails or a guide slot/guide slots matching with the guide slot/guide slots or the guide rail/guide rails to enable the movable printing platen to slide on the transmission platen. The guide slot/guide slots matches/match with the guide rail/guide rails, thereby enabling the movable printing platen to slide relative to the transmission platen. Moreover, the guide slot/guide slots or the guide rail/guide rails is/are staggered with the sliding rail/sliding rails or the sliding chute/sliding chutes on the lifting platen, so that the movable printing platen on the transmission platen can smoothly slide from the transmission platen to the lifting platen without interference. This involves clever design.

4. In the present invention, when the movable printing platen is transferred from the transmission platen onto the lifting platen, the transmission platen slides to a position above the lifting platen, and the transmission platen and the lifting platen have a spatial overlapping region; and when the movable printing platen is transferred from the lifting platen onto the transmission platen, the transmission platen slides to a position above the lifting platen, and the transmission platen and the lifting platen have a spatial overlapping region. Therefore, when the movable printing platen is not disengaged from the transmission platen or the lifting platen, a large portion of the movable printing platen has been in contact with and has matched with the sliding rail/sliding rails (sliding chute/sliding chutes) on the lifting platen or the guide rail/guide rails (guide slot/guide slots) on the transmission platen, thereby implementing a more stable and reliable transfer process of the movable printing platen. This is a very clever design with simple and compact structure.

5. The present invention involves a simple and compact structure, occupies a small area, produces high-quality products, involves high production efficiency, reduces costs of enterprises, and is suitable for promotion and application.

DETAILED DESCRIPTION

Figure 1:
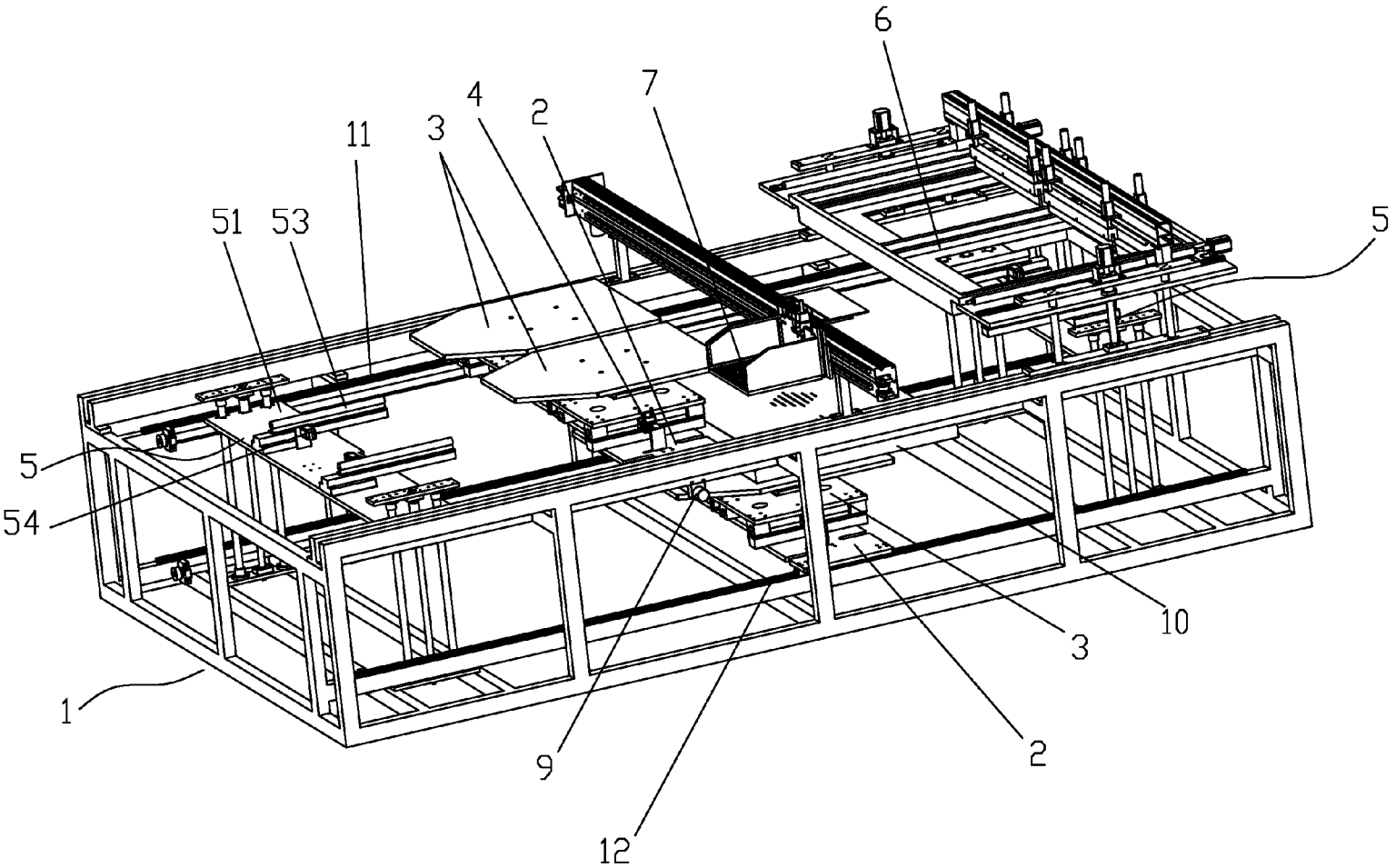
FIG. 1 is a perspective view of the movable printing platen of the upper rack layer separated from the lifting platen according to the present invention.

The present invention is further described below with reference to the accompanying drawings.

As shown in FIG. 1 to FIG. 4, a circulating feeding printer combining screen printing and digital ink jetting includes: a rack 1, the rack 1 includes an upper rack layer 11 and a lower rack layer 12, the upper rack layer 11 and the lower rack layer 12 are respectively provided with a transmission platen 2 capable of moving back and forth relative to the rack 1, each transmission platens 2 is provided with a movable printing platen 3 capable of sliding back and forth relative to the transmission platen 2 and used for bearing a print medium, a locking device 4 for locking the movable printing platen 3 and the transmission platen 2 is arranged between the movable printing platen 3 and the transmission platen 2, platen transfer devices 5 capable of transferring the movable printing platen 3 at the upper rack layer 11 onto the transmission platen 2 at the lower rack layer 12 and transferring the movable printing platen 3 at the lower rack layer 12 onto the transmission platen 2 at the upper rack layer 11 are further disposed on the rack 1, separately located at two sides of the transmission platens 2, and the rack 1 is further provided with a screen printer 6 used for carrying out screen printing and an inkjet printer 7 used for carrying out digital ink jetting on the print mediums on the movable printing platens 3. In a printing process, screen printing may be used as a pre-process, and digital ink jetting is used as a post-process, so that the advantages of the screen printing and the advantages of the digital ink jetting are combined, the screen printing and the digital ink jetting complement each other, thereby achieving better quality of printed products as compared with the quality of conventional printed products. Besides, platen transfer devices 5 respectively disposed at two sides of transmission platens 2 can transfer the movable printing platen 3 at an upper rack layer 11 onto the transmission platen 2 at a lower rack layer 12, and can also transfer the movable printing platen 3 at the lower rack layer 12 onto the transmission platen 2 at the upper rack layer 11. Therefore, after a worker loads a print medium onto the movable printing platen 3 at a material loading station, a platen transfer device 5 transfers the movable printing platen 3 onto the transmission platen 2 at the lower rack layer 12 or the transmission platen 2 at the upper rack layer 11, then the transmission platen 2 delivers the movable printing platen 3 to the screen printer 6 and the inkjet printer 7 for printing, when the first movable printing platen 3 undergoes a printing process at the screen printer 6 or the inkjet printer 7, the worker can load a material onto the other movable printing platen 3, and then the platen transfer device 5 transfers the other movable printing platen 3 with the loaded material, during the process of transferring the other movable printing platen 3, the print medium that is at the printing station first has undergone printing, the movable printing platen 3 is transferred back to the material loading station, the worker takes the print medium that accomplished printing, and reloads a print medium to be printed, thereby implementing continuous material loading and material discharging. Moreover, the movable printing platens 3 cyclically operate between the upper rack layer 11 and the lower rack layer 12, thereby achieving circulating feeding, reducing waiting time of workers, and significantly improving the production efficiency. Furthermore, the movable printing platens 3 cyclically operate between the upper rack layer 11 and the lower rack layer 12 makes the present invention spatially extends upwards, thereby reducing the occupied area of the present invention and reducing land costs.

As shown in FIG. 1, FIG. 6, FIG. 7, and FIG. 8, each of the platen transfer devices 5 includes a lifting platen 51 capable of lifting relative to the rack 1, each movable printing platen 3 is provided with a sliding chute 52/sliding chutes 52 or a sliding rail/sliding rails, the lifting platen 51 is provided with a sliding rail 53/sliding rails 53 or a sliding chute/sliding chutes capable of matching with the sliding chute 52/sliding chutes 52 or the sliding rail/sliding rails to enable the movable printing platen 3 on the transmission platen 2 to slide to the lifting platen 51, and the lifting platen 51 is further provided with a fastening device 54 capable of fastening the movable printing platen 3 and the lifting platen 51. When the movable printing platen 3 is located on the transmission platen 2 and needs to be transferred onto the lifting platen 51, the locking device 4 locks the movable printing platen 3 and the transmission platen 2, the transmission platen 2 moves relative to the rack 1, in the moving process of the transmission platen 2, the sliding rail 53/sliding rails 53 or the sliding chute/sliding chutes on the lifting platen 51 matches with the sliding chute 52/sliding chutes 52 or sliding rail/sliding rails on the movable printing platen 3, at this time, the fastening device 54 is enabled, the fastening device 54 fastens the movable printing platen 3 and the lifting platen 51, then, the locking device 4 is released, the transmission platen 2 moves away from the lifting platen 51, at this time, the movable printing platen 3 is transferred from the transmission platen 2 onto the lifting platen 51, then the lifting platen 51 is raised or lowered relative to the rack 1 to arrive at the upper rack layer 11 or the lower rack layer 12, and the lifting platen 51 docked with the transmission platen 2 at the upper rack layer 11 or the transmission platen 2 at the lower rack layer 12, so that the movable printing platen 3 on the lifting platen 51 is transferred onto the corresponding transmission platen 2, thereby achieving the cyclic operation of the movable printing platen 3. This is a very clever design with simple and compact structure, implements continuous material loading and material discharging by workers, and improves the production efficiency.

Figure 6:
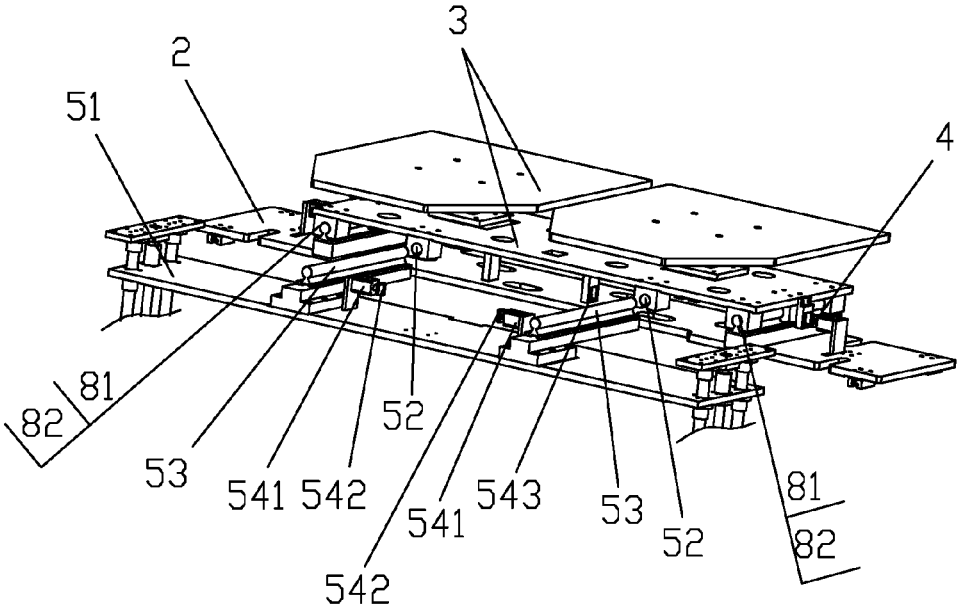
FIG. 6 is a perspective view of components according to the present invention.
Figure 7:
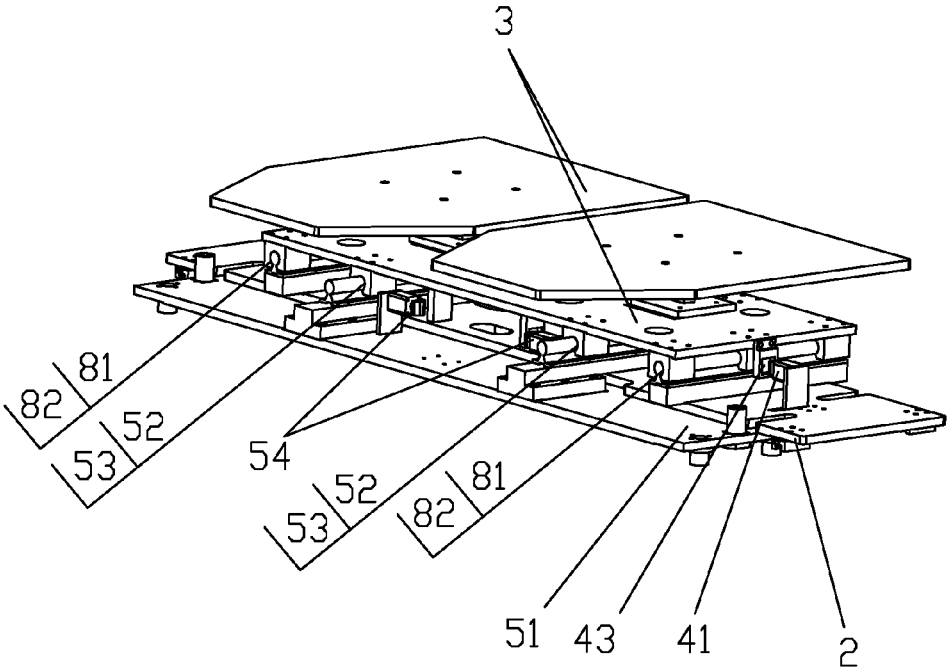
FIG. 7 is another perspective view of components according to the present invention.
Figure 8:
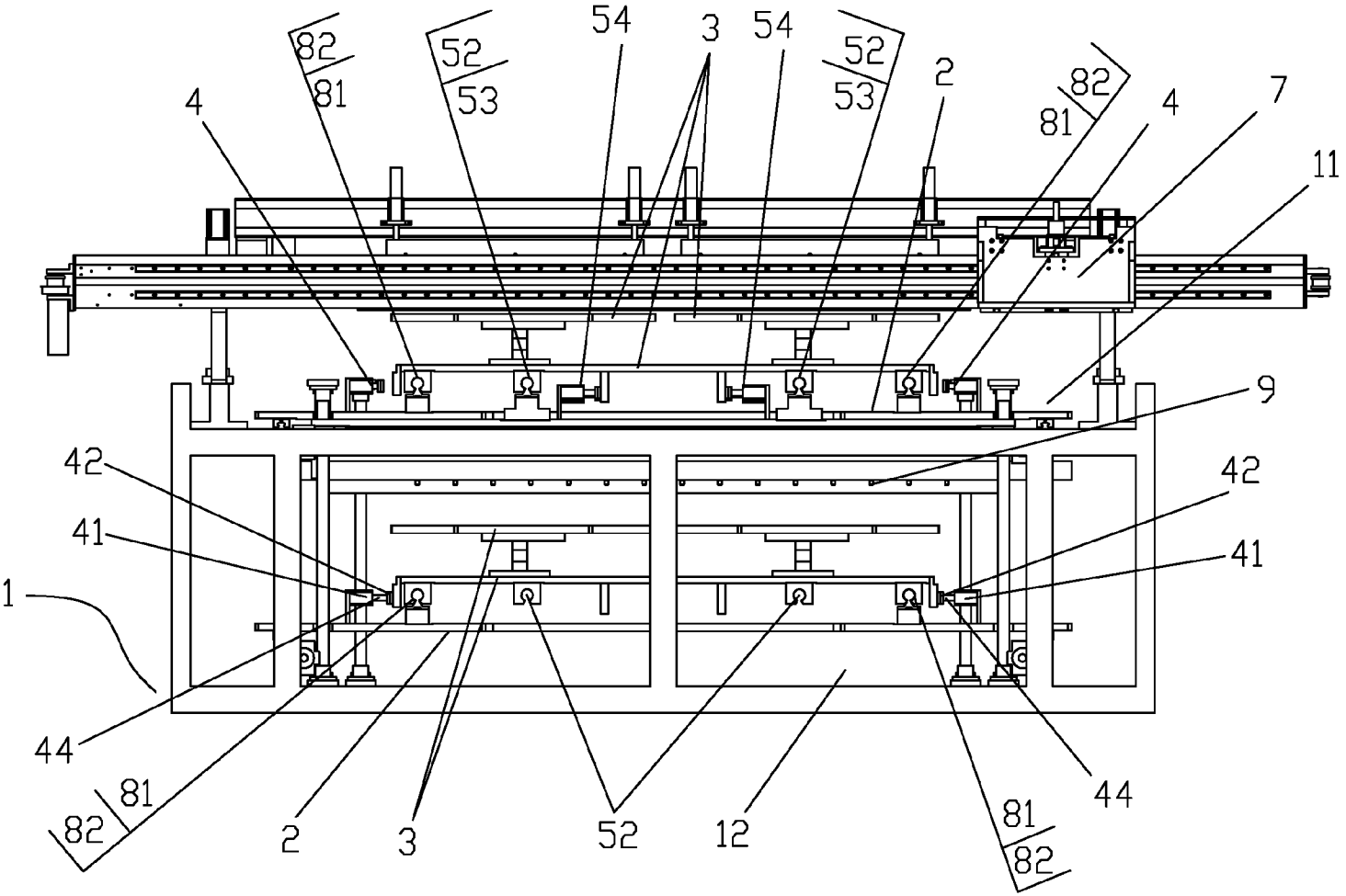
FIG. 8 is the third side view of the present invention.

As shown in FIG. 6 to FIG. 8, the movable printing platen 3 is provided with a guide slot 81/guide slots 81 or a guide rail/guide rails that does/do not overlap the sliding rail 53/sliding rails 53 or the sliding chute/sliding chutes on the lifting platen 51, and the transmission platen 2 is provided with a guide rail 82/guide rails 82 or a guide slot/guide slots matching with the guide slot 81/guide slots 81 or a guide rail/guide rails to enable the movable printing platen 3 to slide on the transmission platen 2. The guide slot 81/guide slots 81 matches/match with the guide rail/guide rails, thereby enabling the movable printing platen 3 to slide relative to the transmission platen 2. Moreover, the guide slot 81/guide slots 81 or the guide rail/guide rails staggers/stagger with the sliding rail 53/sliding rails 53 or the sliding chute/sliding chutes on the lifting platen 51, so that the movable printing platen 3 on the transmission platen 2 can smoothly slide from the transmission platen 2 to the lifting platen 51 without interference. This involves clever design.

Figure 3:
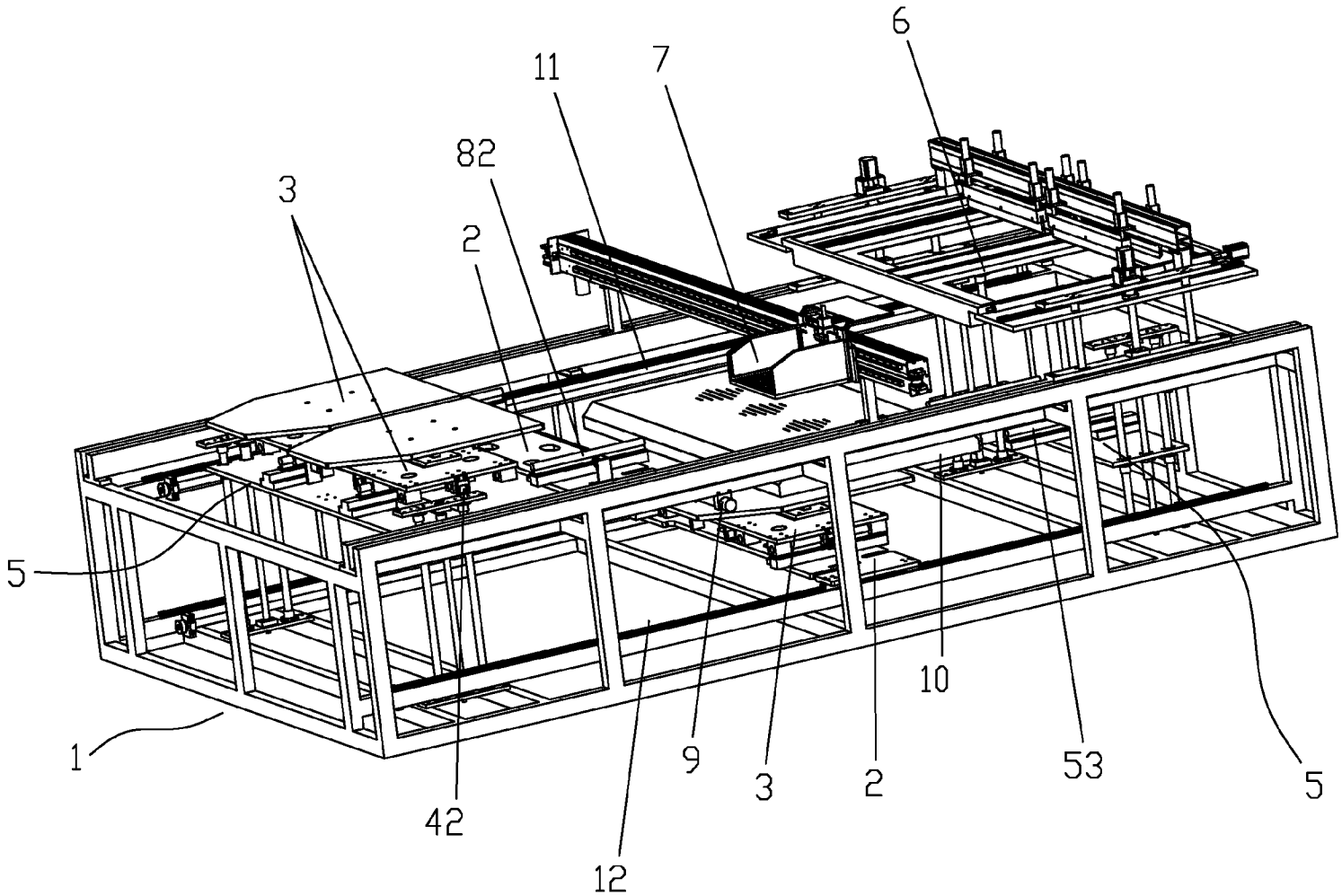
FIG. 3 is a perspective view of the present invention, wherein the movable printing platen of the upper rack layer is transferred onto the lifting platen and the transmission platen is far away from the lifting platen.
Figure 4:
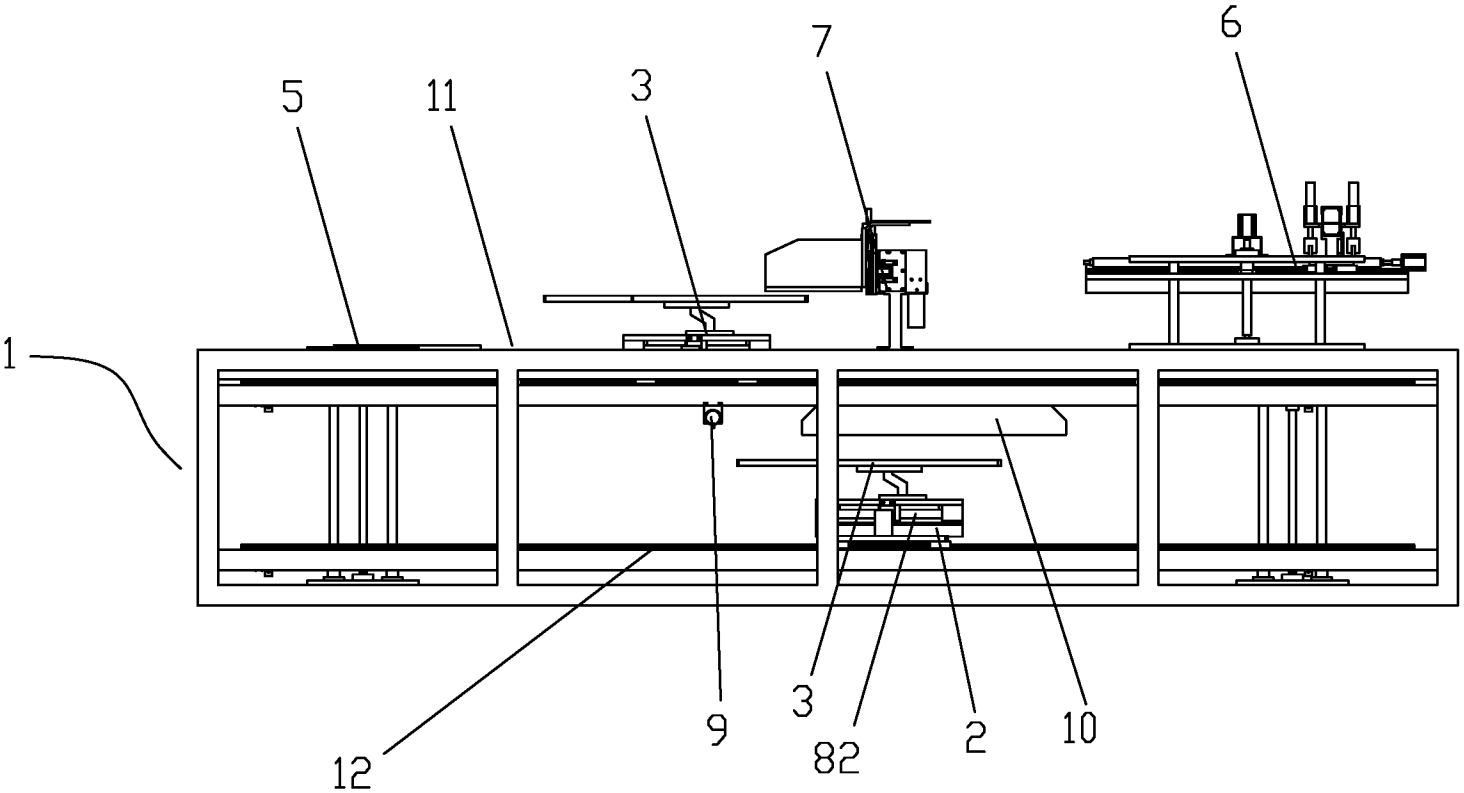
FIG. 4 is the first side view of the present invention.

As shown in FIG. 3 and FIG. 7, the locking device 4 includes a locking cylinder 41 disposed on the transmission platen 2, a locking block 42 is connected to the cylinder rod 44 rod of the locking cylinder 41 (FIG. 8), and the movable printing platen 3 is provided with a locking slot 43 matching with the locking block 42. The movable printing platen 3 and the transmission platen 2 are locked as long as the locking block 42 extends into the locking slot 43. The structure is very simple and reliable.

As shown in FIG. 6 to FIG. 8, the fastening device 54 includes a fastening cylinder 541 disposed on the lifting platen 51, a fastening block 542 is connected to the cylinder rod of the fastening cylinder 541, and the movable printing platen 3 is provided with a fastening slot 543 matching with the fastening block 542. The movable printing platen 3 and the transmission platen 51 are fastened as long as the fastening block 542 extends into the fastening slot 543. The structure is very simple and reliable.

As shown in FIG. 7, when the movable printing platen 3 is transferred from the transmission platen 2 onto the lifting platen 51, the transmission platen 2 slides to a position above the lifting platen 51, and the transmission platen 2 and the lifting platen 51 have a spatial overlapping region; and when the movable printing platen 3 is transferred from the lifting platen 51 onto the transmission platen 2, the transmission platen 2 slides to a position above the lifting platen 51, and the transmission platen 2 and the lifting platen 51 have a spatial overlapping region. When the movable printing platen 3 is not disengaged from the transmission platen 2 or the lifting platen 51, a large portion of the movable printing platen 3 has been in contact with and has matched with the sliding rail 53/sliding rails 53 (sliding chute/sliding chutes) on the lifting platen 51 or the guide rail 82/guide rails 82 (guide slot/guide slots) on the transmission platen 2, thereby implementing a more stable and reliable transfer process of the movable printing platen 3. This involves clever design and a simple and compact structure.

Figure 2:
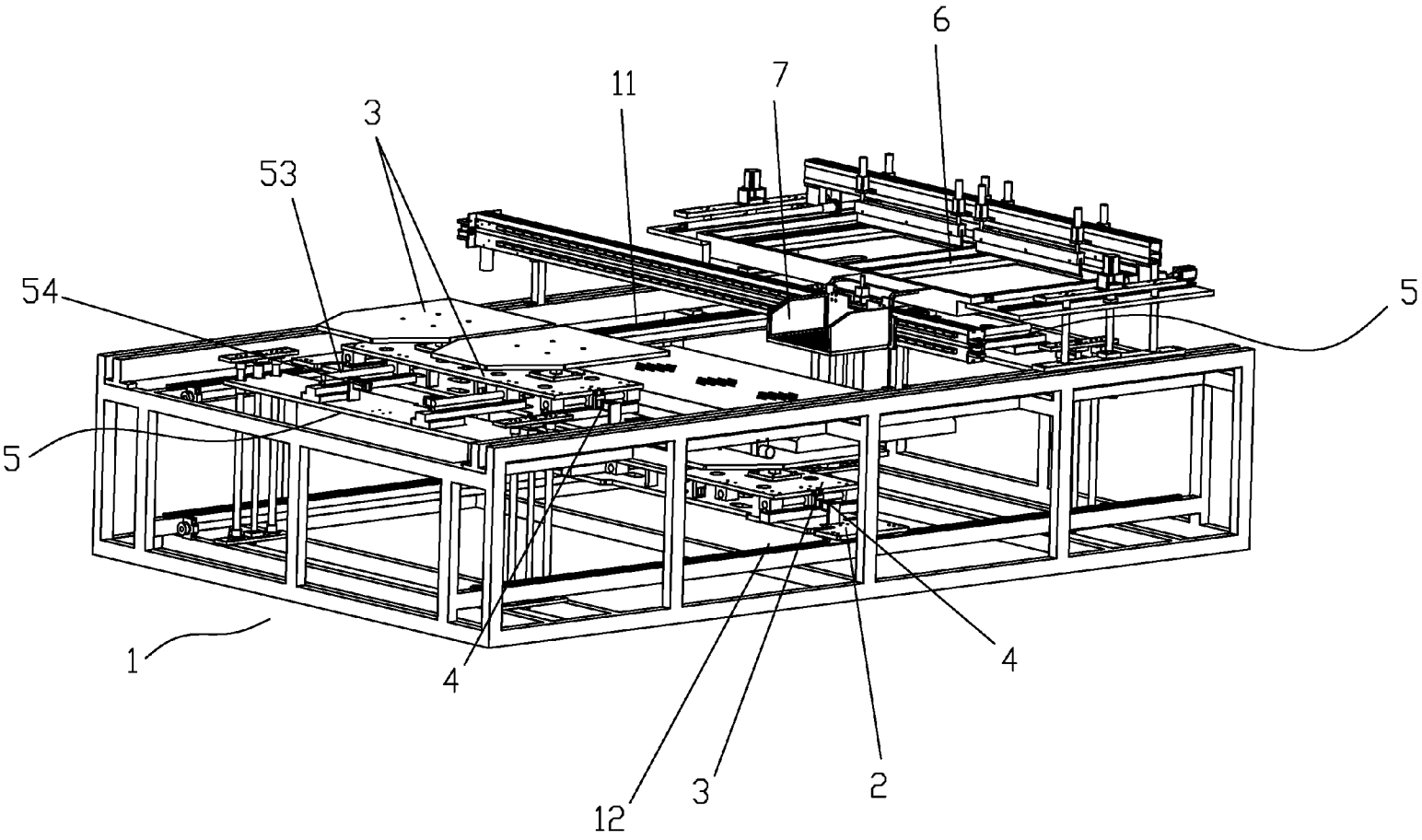
FIG. 2 is a perspective view of a process of transferring the movable printing platen of the upper rack layer onto the lifting platen according to the present invention.

As shown in FIG. 1 to FIG. 3, the rack 1 is further provided with a spraying device 9 used for spraying and a drying device 10 used for drying the print medium on the movable printing platen 3. The spraying device 9 and the drying device 10 can preprocess the print medium before the screen printing, thereby improving the quality of final products.

Figure 5:
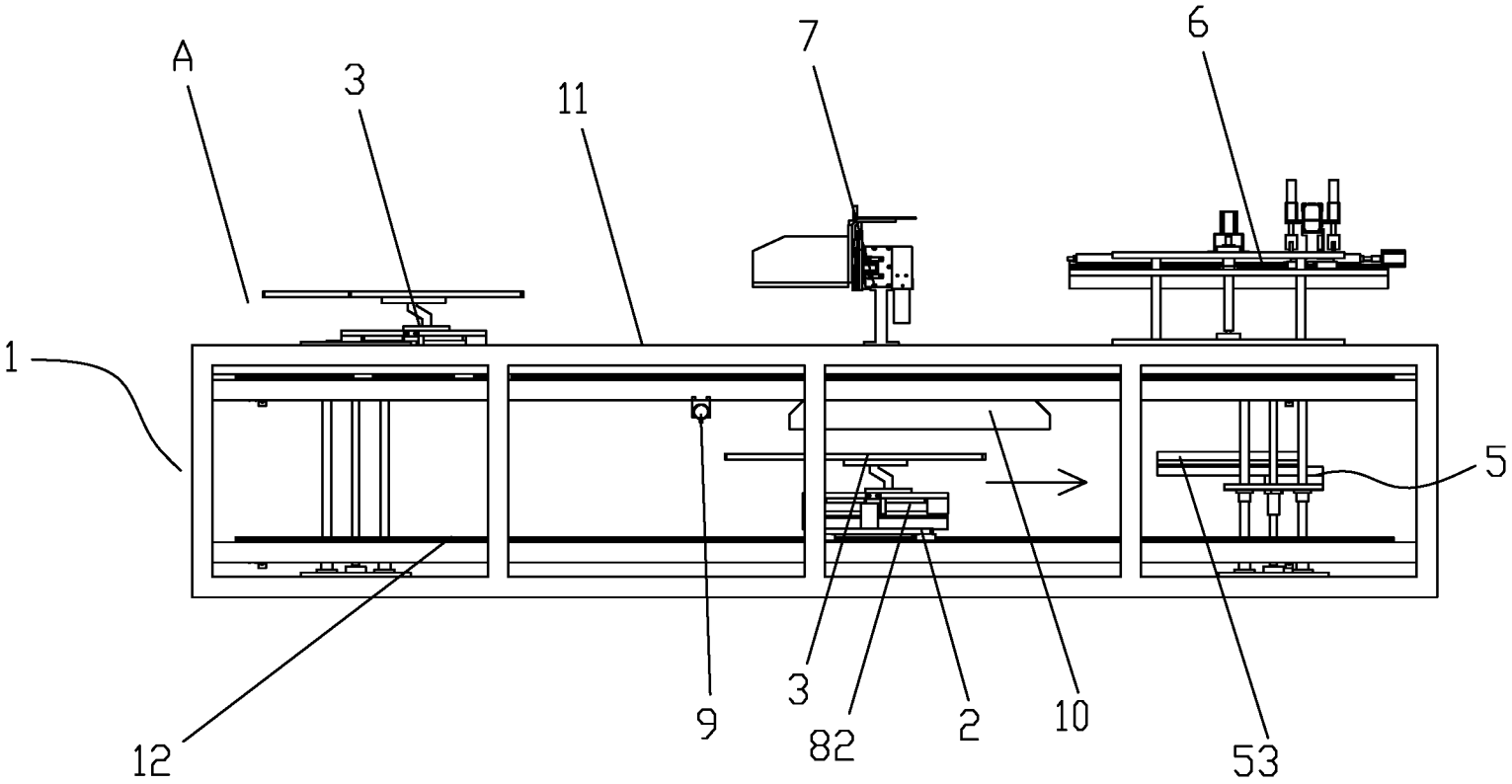
FIG. 5 is the second side view of the present invention.

Specific Working Principles:

(1) First, the movable printing platen 3 is located on the lifting platen 51, and the fastening device 54 fastens the movable printing platen 3 and the lifting platen 51 together. A worker loads a print medium (for example, cloth and the like) onto the movable printing platen 3 of the upper rack layer 11 at the material loading/discharging station A (as shown in FIG. 5), and together with the movable printing platen 3 loaded with the print medium, the lifting platen 51 moves downwards to the lower rack layer 12.

(2) In the process that the lifting platen 51 moves downwards together with the movable printing platen 3 loaded with the print medium, the movable printing platen 3 that is first at the lower rack layer 12 is transferred by the transmission platen 2 at the lower rack layer 12 to the lifting platen 51 at the other side of the transmission platen 2 (as show in FIG. 5, the transmission platen 2 at the lower rack layer 2 is moving, together with the movable printing platen 3, towards the platen transfer device 5 along an arrow direction), the platen transfer device 5 moves, together with the movable printing platen 3 transferred from the transmission platen 2, upwards to the upper rack layer 11, and the platen transfer device 5 dock with the transmission platen 2 at the upper rack layer 11 again, so that the movable printing platen 3 that is first at the lower rack layer 12 is transferred onto the transmission platen 2 at the upper rack layer 11.

(3) After the transmission platen 2 at the lower rack layer 12 transfers the movable printing platen 3 that is first at the lower rack layer 12 onto the lifting platen 51 at the other side of the transmission platen 2, the transmission platen 2 at the lower rack layer 12 moves relative to the rack 1 to be close to the movable printing platen 3 that is loaded with the print medium and is lowered from the upper rack layer 11, the guide rail 82/guide rails 82 of the transmission platen 2 is/are inserted into the guide slot 81/guide slots 81 of the movable printing platen 3 loaded with the print medium, then the fastening device 54 is released, the movable printing platen 3 loaded with the print medium, and the lifting platen 51 are unlocked, at the same time, the locking device 4 locks the movable printing platen 3 loaded with the print medium, and the transmission platen 2, then the transmission platen 2 moves away from the lifting platen 51, so that the sliding chute 52/sliding chutes 52 of the movable printing platen 3 loaded with the print medium is/are separated from the sliding rail 53/sliding rails 53 on the lifting platen 51, at this time, the movable printing platen 3 loaded with the print medium is separated from the lifting platen 51 and therefore is transferred onto the transmission platen 2 at the lower rack layer 12, and the transmission platen 2 delivers the movable printing platen 3 loaded with the print medium to the position below the spraying device 9 to carry out a spraying process, and further delivers same to the drying device 10 for drying.

(4) After the foregoing movable printing platen 3 loaded with the print medium moves onto the transmission platen 2 at the lower rack layer 12, the lifting platen 51 that is just separated from the movable printing platen 3 loaded with the print medium is raised to the upper rack layer 11 again, the transmission platen 2 at the upper rack layer 11 and the lifting platen 51 are docked again, so that the transmission platen 2 transfers the movable printing platen 3 at the upper rack layer 11 (the movable printing platen 3 is transferred from the lower rack layer 12 to the upper rack layer 11 in the foregoing process (2) onto the lifting platen 51, and the worker loads a print medium to the movable printing platen 3 again at the material loading/discharging station A. When the worker loads the print medium to the movable printing platen 3, the print medium that is loaded earlier is transferred by the transmission platen 2 and the other lifting platen 51 to the screen printer 6 and the ink-jet printer 7 for processing.

(5) After the movable printing platen 3 (the movable printing platen 3 is transferred from the lower rack layer 12 onto the upper rack layer 11 in the process (2) is loaded with the print medium, the movable printing platen 3 is lowered along with the lifting platen 51, the movable printing platen 3 and the transmission platen 2 at the lower rack layer 12 are docked after the movable printing platen 3 is lowered to the lower rack layer 12, after the docking is completed, the lifting platen 51 moving downwards together with the movable printing platen 3 is raised to the material loading/discharging station A of the upper rack layer 11 again, at this time, the movable printing platen 3 that has undergone printing at the inkjet printer 7 moves to the material loading/discharging station A and is transferred onto the lifting platen 51, and the worker takes the print medium printed and loads a print medium again.

In this way, one cycle is completed. The entire production manner implements continuous material loading and discharging, implements circulating feeding, reduces waiting time, and significantly improves the production efficiency.

The invention claimed is:

1. A circulating feeding printer combining screen printing and digital ink jetting, comprising:

a rack, wherein the rack includes an upper rack layer and a lower rack layer, and the upper rack layer and the lower rack layer are each respectively provided with a transmission platen capable of moving back and forth relative to the rack, each transmission platen is provided with a movable printing platen, which is capable of sliding back and forth relative to the transmission platen and used for bearing a print medium, a locking device for locking the movable printing platen and the transmission platen is arranged between the movable printing platen and the transmission platen, platen transfer devices capable of transferring the movable printing platen at the upper rack layer onto the transmission platen at the lower rack layer and transferring the movable printing platen at the lower rack layer onto the transmission platen at the upper rack layer are further disposed on the rack, separately located at two sides of the transmission platen, and the rack is further provided with a screen printer used for carrying out screen printing and an inkjet printer used for carrying out digital ink jetting on the print mediums on the movable printing platen.

2. The circulating feeding printer combining screen printing and digital ink jetting according to claim 1, wherein each of the platen transfer devices includes a lifting platen capable of lifting relative to the rack, each movable printing platen is provided with a sliding chute/sliding chutes or a sliding rail/sliding rails, the lifting platen is provided with a sliding rail/sliding rails or a sliding chute/sliding chutes capable of matching with the sliding chute/sliding chutes or the sliding rail/sliding rails to enable the movable printing platen on the transmission platen to slide to the lifting platen, and the lifting platen is further provided with a fastening device capable of fastening the movable printing platen and the lifting platen.

3. The circulating feeding printer combining screen printing and digital ink jetting according to claim 2, wherein the fastening device includes a fastening cylinder disposed on the lifting platen, a fastening block is connected to a cylinder rod of the fastening cylinder, and the movable printing platen is provided with a fastening slot matching with the fastening block.

4. The circulating feeding printer combining screen printing and digital ink jetting according to claim 2, wherein the locking device includes a locking cylinder disposed on the transmission platen, a locking block is connected to a cylinder rod of the locking cylinder, and the movable printing platen is provided with a locking slot matching with the locking block.

5. The circulating feeding printer combining screen printing and digital ink jetting according to claim 2, wherein when the movable printing platen is transferred from the transmission platen onto the lifting platen, the transmission platen slides to a position above the lifting platen, and the transmission platen and the lifting platen have a spatial overlapping region; and when the movable printing platen is transferred from the lifting platen onto the transmission platen, the transmission platen slides to a position above the lifting platen, and the transmission platen and the lifting platen have a spatial overlapping region.

6. The circulating feeding printer combining screen printing and digital ink jetting according to claim 2, wherein the rack is further provided with a spraying device used for spraying and a drying device used for drying the print medium on the movable printing platen.

7. The circulating feeding printer combining screen printing and digital ink jetting according to claim 2, wherein the movable printing platen is provided with a guide slot/guide slots or a guide rail/guide rails that does/do not overlap the sliding rail/sliding rails or the sliding chute/sliding chutes on the lifting platen, and the transmission platen is provided with a guide rail/guide rails or a guide slot/guide slots matching with the guide slot/guide slots or a guide rail/guide rails to enable the movable printing platen to slide on the transmission platen.

8. The circulating feeding printer combining screen printing and digital ink jetting according to claim 7, wherein when the movable printing platen is transferred from the transmission platen onto the lifting platen, the transmission platen slides to a position above the lifting platen, and the transmission platen and the lifting platen have a spatial overlapping region; and when the movable printing platen is transferred from the lifting platen onto the transmission platen, the transmission platen slides to a position above the lifting platen, and the transmission platen and the lifting platen have a spatial overlapping region.

9. The circulating feeding printer combining screen printing and digital ink jetting according to claim 7, wherein the locking device includes a locking cylinder disposed on the transmission platen, a locking block is connected to a cylinder rod of the locking cylinder, and the movable printing platen is provided with a locking slot matching with the locking block.

10. The circulating feeding printer combining screen printing and digital ink jetting according to claim 7, wherein the fastening device includes a fastening cylinder disposed on the lifting platen, a fastening block is connected to a cylinder rod of the fastening cylinder, and the movable printing platen is provided with a fastening slot matching with the fastening block.

11. The circulating feeding printer combining screen printing and digital ink jetting according to claim 7, wherein when the movable printing platen is transferred from the transmission platen onto the lifting platen, the transmission platen slides to a position above the lifting platen, and the transmission platen and the lifting platen have a spatial overlapping region; and when the movable printing platen is transferred from the lifting platen onto the transmission platen, the transmission platen slides to a position above the lifting platen, and the transmission platen and the lifting platen have a spatial overlapping region.

12. The circulating feeding printer combining screen printing and digital ink jetting according to claim 7, wherein the rack is further provided with a spraying device used for spraying and a drying device used for drying the print medium on the movable printing platen.

13. The circulating feeding printer combining screen printing and digital ink jetting according to claim 1, wherein the locking device includes a locking cylinder disposed on the transmission platen, a locking block is connected to a cylinder rod of the locking cylinder, and the movable printing platen is provided with a locking slot matching with the locking block.

14. The circulating feeding printer combining screen printing and digital ink jetting according to claim 1, wherein the rack is further provided with a spraying device used for spraying and a drying device used for drying the print medium on the movable printing platen.

* * * * *